US007025633B2

(12) United States Patent
Kumamoto et al.

(10) Patent No.: US 7,025,633 B2
(45) Date of Patent: Apr. 11, 2006

(54) DIFFERENTIAL TRANSMISSION CONNECTOR

(75) Inventors: Tadashi Kumamoto, Shinagawa (JP); Mitsuru Kobayashi, Shinagawa (JP); Junichi Akama, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/832,418

(22) Filed: Apr. 27, 2004

(65) Prior Publication Data

US 2004/0242072 A1 Dec. 2, 2004

(30) Foreign Application Priority Data

May 27, 2003 (JP) ..... 2003-148693

(51) Int. Cl.
*H01R 13/648* (2006.01)

(52) U.S. Cl. ..... 439/608; 439/941

(58) Field of Classification Search ..... 439/608, 439/108, 101, 941
See application file for complete search history.

(56) References Cited

U.S. PATENT DOCUMENTS 5,645,436 A * 7/1997 Shimizu et al. ..... 439/108
6,652,318 B1 * 11/2003 Winings et al. ..... 439/608

FOREIGN PATENT DOCUMENTS

JP 2001-043933 2/2001

* cited by examiner

*Primary Examiner*—Javaid H. Nasri
(74) *Attorney, Agent, or Firm*—Staas & Halsey LLP

(57) ABSTRACT

A connector for differential transmission is disclosed. The connector includes a housing made of an insulating material, the housing including a connector connection opening on its top face, multiple signal contact pairs each including first and second signal contact members, the signal contact members each including a signal terminal part, and multiple ground contact members each including ground terminal parts. The signal contact pairs and the ground contact members are disposed alternately in the housing so that the signal terminal parts of the first and second signal contact members of the signal contact pairs and the ground terminal parts of the ground contact members are provided on the side of the bottom face of the housing. The signal terminal parts of the first and second signal contact members extend in the same direction in each signal contact pair.

10 Claims, 11 Drawing Sheets

DIFFERENTIAL TRANSMISSION CONNECTOR

BACKGROUND OF THE INVENTION

1. Field of the Invention

The present invention relates generally to connectors for differential transmission, and more particularly to a so-called straight-type connector for differential transmission to be mounted in a vertical position on a printed circuit board to have its connector connection opening parallel to the printed circuit board, the connector being applied to a part performing differential transmission of data.

2. Description of the Related Art

Differential transmission has been employed in many cases as a method of transmitting data between personal computers and peripheral devices. Differential transmission uses a pair of lines for each data element, and simultaneously transmits a "+" signal to be transmitted and a "−" signal equal in magnitude and opposite in direction to the "+" signal. Differential transmission has the advantage of being less susceptible to noise compared with a normal transmission method.

In order for differential transmission to work normally, the paired lines, one for transmitting the "+" signal and the other for the "−" signal, should be parallel and equal in length. Further, ground potential should be provided between the paired adjacent lines so that a shield is provided therebetween.

Japanese Laid-Open Patent Application No. 2001-043933 discloses a right angle-type jack connector for differential transmission to be mounted on a printed circuit board to have its connector connection opening perpendicular to the printed circuit board.

Connection modes have diversified so that there is a demand for a straight-type connector for differential transmission whose connector connection opening is parallel to a printed circuit board.

FIGS. 1A through 1C are diagrams for illustrating the case of simply converting a connector for differential transmission (differential transmission connector) of a right angle type into that of a straight type. In FIGS. 1A through 1C, $X_1$–$X_2$, $Y_1$–$Y_2$, and $Z_1$–$Z_2$ indicate the directions of length, the directions of width, and the directions of height, respectively, of the jack connector.

Referring to FIG. 1A, a right angle-type differential transmission jack connector 1 includes a pair of signal contact members 2 and 3, a ground contact member 4, and a housing 5. The signal contact members 2 and 3 include signal contact parts 2*a* and 3*a*, respectively, and signal terminal parts 2*b* and 3*b*, respectively. The ground contact member 4 includes a ground contact part 4*a* and a ground terminal part 4*b*. The housing 5 includes a connector connection opening 5*a* facing the $Y_2$ direction.

By providing the signal contact parts 2*a* and 3*a* so that the signal contact parts 2*a* and 3*a* extend in the $Z_1$ direction on the $Y_1$ and $Y_2$ sides, respectively, the right angle-type jack connector 1 is converted into a straight-type differential transmission jack connector 10 as shown in FIG. 1B. The jack connector 10 includes a pair of signal contact members 2A and 3A, a ground contact member 4A, and a housing 5A. The signal contact members 2A and 3A include signal contact parts 2Aa and 3Aa, respectively, and signal terminal parts 2Ab and 3Ab, respectively. The ground contact member 4A includes a ground contact part 4Aa and ground terminal parts 4Ab and 4Ac. The signal terminal part 2Ab extends from the signal contact part 2Aa in the $Y_1$ direction.

The signal terminal part 3Ab extends from the signal contact part 3Aa in the $Y_2$ direction. That is, the signal terminal parts 2Ab and 3Ab extend in the opposite directions. The housing 5A includes a connector connection opening 5Aa facing the $Z_1$, direction.

FIG. 1C shows the pattern of part of a printed circuit board 20 on which part the straight-type jack connector 10 is mounted. The pattern includes first signal pads 21, second signal pads 22, and ground pads 23. Paired first and second signal wiring patterns 31 and 32 run parallel to each other so as to couple "+" and "−" signals. A belt-like part 33 extends between the first and second signal pads 21 and 22.

The belt-like part 33 has a small width $W_1$ so that it is difficult to form a large number of signal wiring patterns 31 and 32 in the part 33.

SUMMARY OF THE INVENTION

Accordingly, it is a general object of the present invention to provide a connector for differential transmission in which the above-described disadvantage is eliminated.

A more specific object of the present invention is to provide a connector for differential transmission on which signal wiring patterns can be formed with a sufficient space.

The above objects of the present invention are achieved by a connector for differential transmission, including: a housing made of an insulating material, the housing including a connector connection opening on a first face thereof; a plurality of signal contact pairs each including first and second signal contact members, the signal contact members each including a signal terminal part; and a plurality of ground contact members each including a plurality of ground terminal parts, wherein: the signal contact pairs and the ground contact members are disposed alternately in the housing so that the signal terminal parts of the first and second signal contact members of the signal contact pairs and the ground terminal parts of the ground contact members are provided on a side of a second face of the housing, the second face opposing the first face thereof; and the signal terminal parts of the first and second signal contact members extend in a same direction in each signal contact pair.

According to the above-described connector, the signal terminal parts of the first and second signal contact members extend in the same direction in each signal contact pair. Accordingly, in a part of a printed circuit board on which part multiple pads on which the connector is mounted are arranged, a pad to which the signal terminal part of the first signal contact member is soldered and a pad to which the signal terminal part of the second signal contact member is soldered are disposed adjacently in a line. Therefore, signal wiring patterns extending from the two pads can be formed with a sufficient space using a wide area outside the part where the multiple pads are formed side by side.

The above objects of the present invention are also achieved by a connector for differential transmission, including: a housing made of an insulating material, the housing including a connector connection opening on a first face thereof; a plurality of signal contact pairs each including first and second signal contact members, the signal contact members each including a signal terminal part; and a plurality of ground contact members each including a plurality of ground terminal parts, wherein: the signal contact pairs and the ground contact members are disposed alternately in the housing so that the signal terminal parts of the first and second signal contact members of the signal contact pairs and the ground terminal parts of the ground contact members are provided on a side of a second face of the housing, the second face opposing the first face thereof; and the signal terminal parts of the first and second signal contact members extend in a first direction in a first one of the signal contact pairs, and the signal terminal parts of the first and second signal contact members extend in a second direction opposite to the first direction in a second one of the signal contact pairs.

According to the above-described connector, the signal terminal parts of the first and second signal contact members of one of the signal contact pairs extend in a first direction, and the signal terminal parts of the first and second signal contact members of another one of the signal contact pairs extend in a second direction opposite to the first direction. Accordingly, in a part of a printed circuit board on which part multiple pads on which the connector is mounted are arranged, a pad to which the signal terminal part of the first signal contact member of the one of the signal contact pair is soldered and a pad to which the signal terminal part of the second signal contact member of the one of the signal contact pair is soldered are disposed adjacently in a first line, and signal wiring patterns extending from the two pads can be formed with a sufficient space using a wide area outside the first line. Further, a pad to which the signal terminal part of the first signal contact member of the other one of the signal contact pair is soldered and a pad to which the signal terminal part of the second signal contact member of the other one of the signal contact pair is soldered are disposed adjacently in a second line, and signal wiring patterns extending from the two pads can be formed with a sufficient space using a wide area outside the second line. Accordingly, the signal wiring patterns can be formed to be dispersed in the area outside the first line and the area outside the second line.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

Figure 1A:
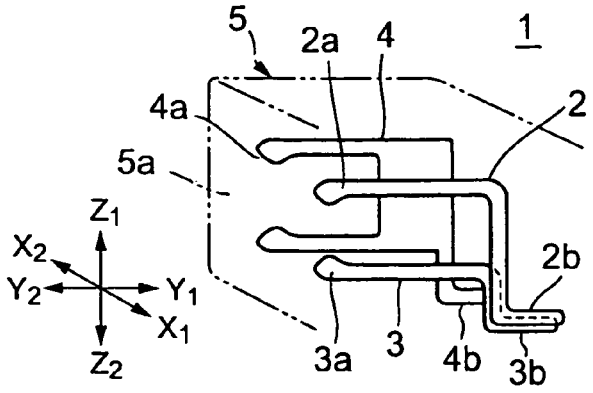
FIG.1A PRIOR ART
FIGS. 1A through 1C are diagrams for illustrating the case of simply converting a differential transmission connector of a right angle type into that of a straight type.
Figure 1B:
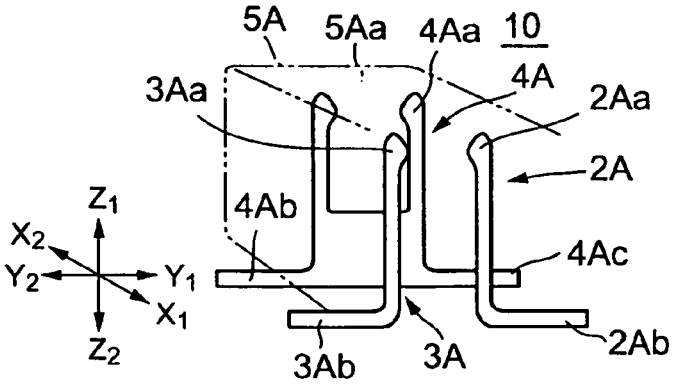
FIG.1B PRIOR ART
Figure 1C:
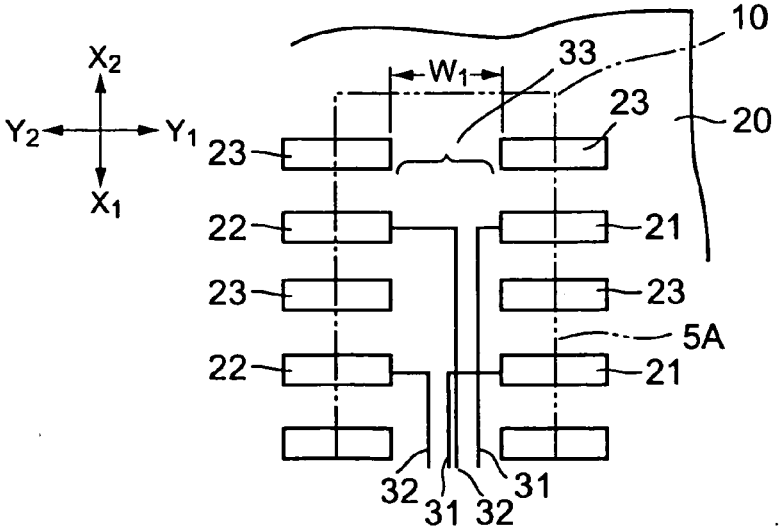
FIG.1C PRIOR ART
Figure 2:
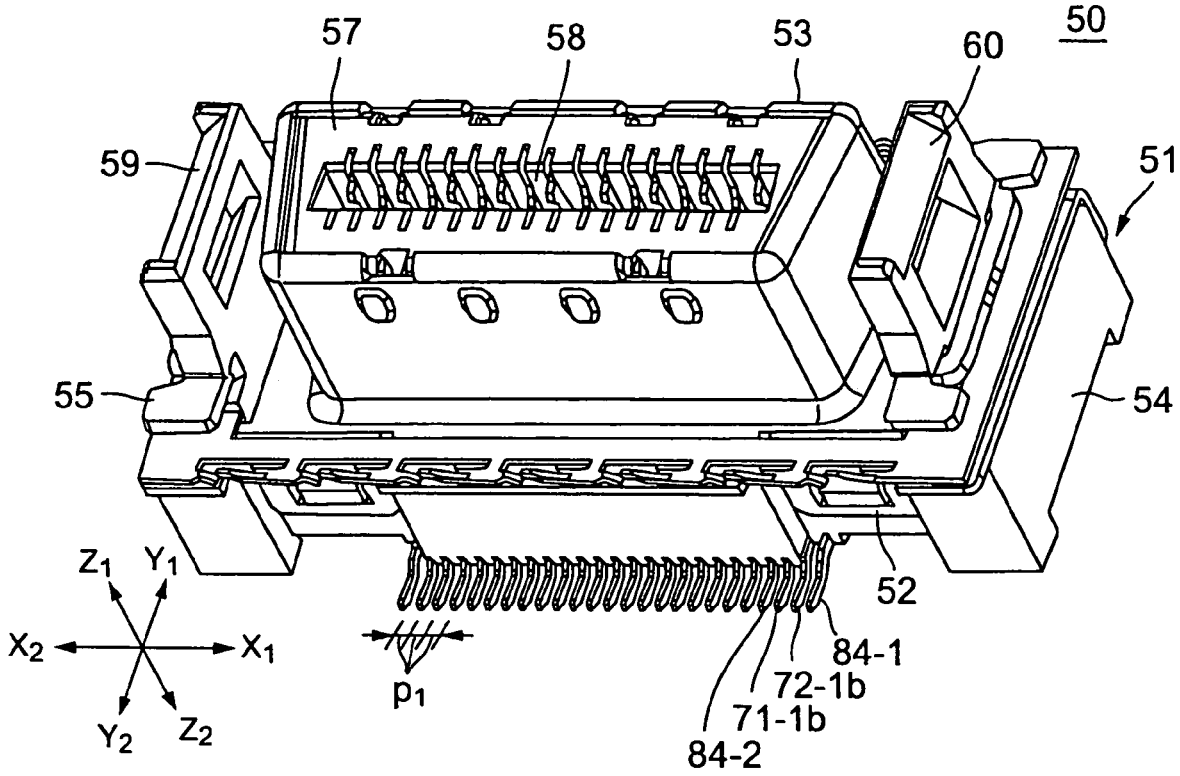
FIG. 2 is a perspective view of a differential transmission jack connector according to a first embodiment of the present invention.
Figure 3:
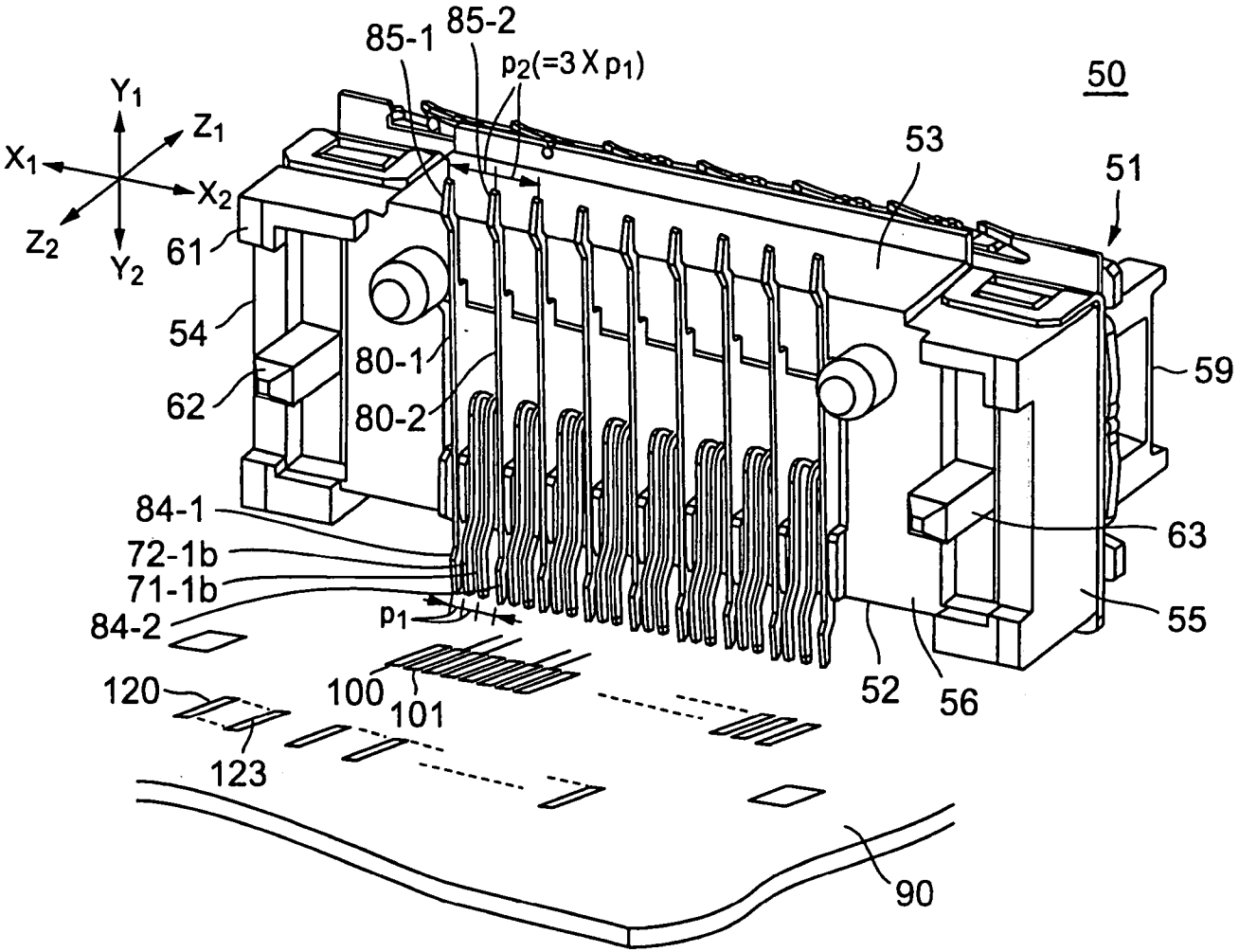
FIG. 3 is a diagram showing the jack connector and a printed circuit board, the jack connector being viewed from its bottom side, according to the first embodiment of the present invention.
Figure 4B:
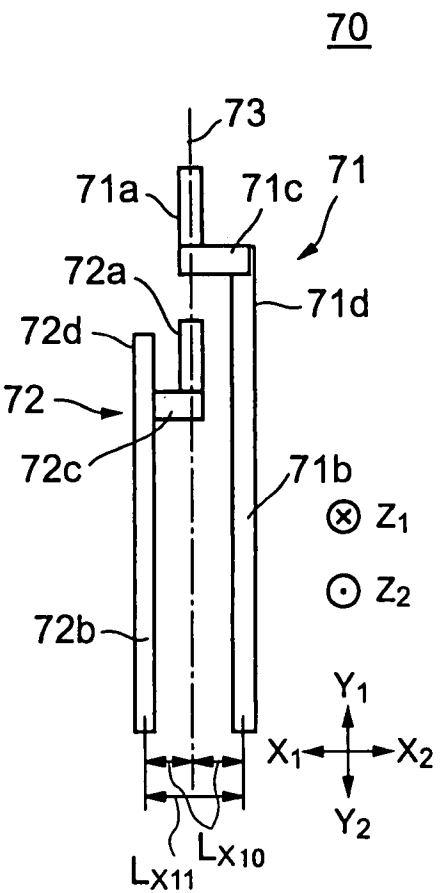
FIGS. 4A and 4B are diagrams showing a signal contact pair according to the first embodiment of the present invention.
Figure 5:
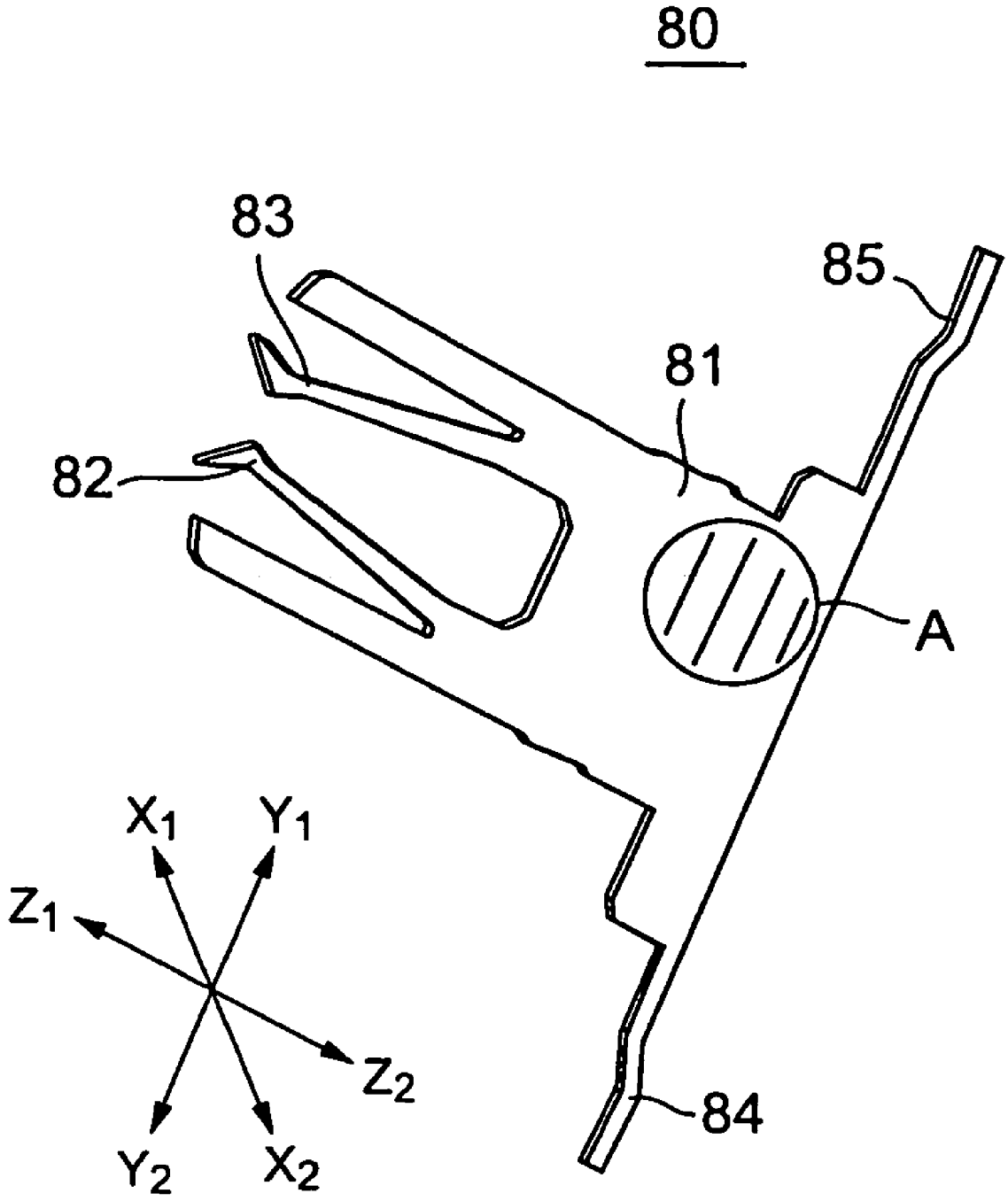
FIG. 5 is a diagram showing a ground contact member according to the first embodiment of the present invention.
Figure 6:
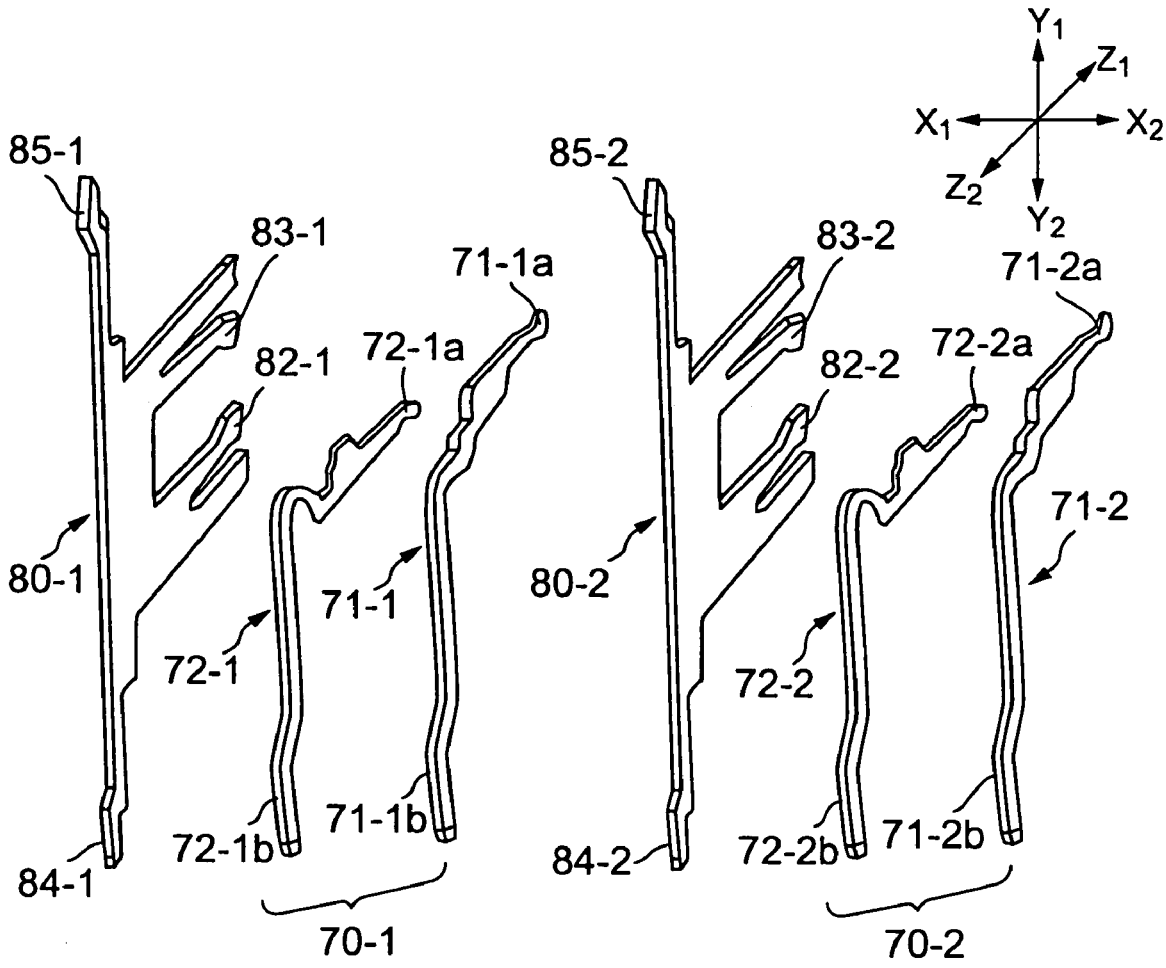
FIG. 6 is a diagram showing an arrangement of the signal contact pairs and the ground contact members in the jack connector according to the first embodiment of the present invention.

FIGS. 2 and 3 are diagrams showing a straight-type differential transmission jack connector 50 according to a first embodiment of the present invention. In FIGS. 2 and 3, $X_1$–$X_2$, $Y_1$–$Y_2$, and $Z_1$–$Z_2$ indicate the directions of length, the directions of width, and the directions of height, respectively, of the jack connector 50. FIG. 3 shows the jack connector 50 rotated 180° about its axis extending along the $Y_1$–$Y_2$ directions or the Y-axis from the position shown in FIG. 2. In a housing 51 of the jack connector 50, signal contact pairs 70 shown in FIGS. 4A and 4B and ground contact members 80 shown in FIG. 5 are disposed alternately as shown in FIG. 6.

Referring to FIGS. 2 and 3, the housing 51 is made of an insulating material, and is shaped like a substantially rectangular parallelepiped extending in the $X_1$–$X_2$ directions or along the X-axis. The housing 51 has opposing lengthwise $Y_2$-side and $Y_1$-side faces 52 and 53, opposing widthwise $X_1$-side and $X_2$-side faces 54 and 55, a bottom face 56 on the $Z_2$ side, and a top face 57 on the $Z_1$ side. A connector connection opening 58 to which a plug connector is connected is formed in the center of the top face 57. Latch parts 59 and 60 that engage and stop the plug connector are formed on the $X_2$ and $X_1$ sides, respectively, of the top surface 57. Referring to FIG. 3, standoff parts 61 and mounting positioning pillar parts 62 and 63 are formed on the bottom face 56.

Figure 4A:
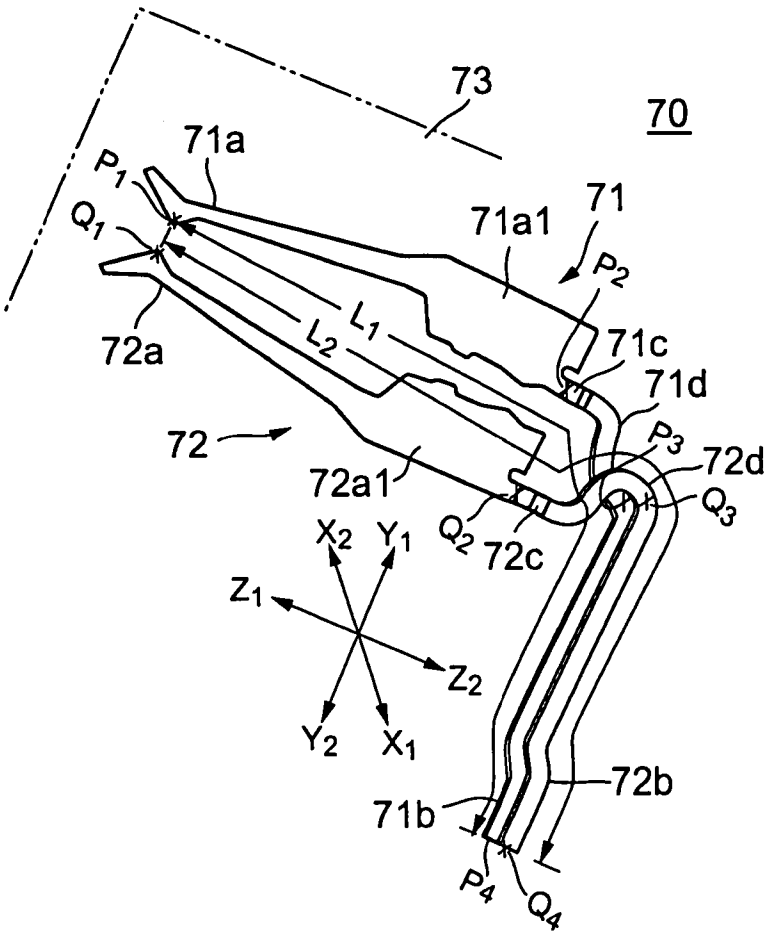

Referring to FIG. 4A, each signal contact pair 70 is composed of first and second signal contact members 71 and 72.

The first signal contact member 71 having a substantially L-letter shape includes a signal contact part 71*a* between $P_1$ and $P_2$ and a signal terminal part 71*b* between $P_2$ and $P_4$ via $P_3$. The second signal contact member 72 having a substantially L-letter shape includes a signal contact part 72*a* between $Q_1$ and $Q_2$ and a signal terminal part 72*b* between $Q_2$ and $Q_4$ via $Q_3$. The signal contact parts 71*a* and 72*a* are arranged in the same Y-Z plane 73 so as to oppose each other along the Y-axis and extend along the $Z_1$–$Z_2$ directions or the Z-axis. The signal contact parts 71*a* and 72*a* have plate-like base parts 71*a*1 and 72*a*1, respectively, on the $Z_2$ side. The signal terminal parts 71*b* and 72*b* extend along the Y-axis, opposing each other. Referring to FIG. 4B, the signal terminal part 71*b* is offset by a distance $Lx_{10}$ in the $X_1$ direction relative to the Y-Z plane 73 at a part 71*c* on its root side and the signal terminal part 72*b* is offset by the same distance $Lx_{10}$ in the $X_2$ direction relative to the Y-Z plane 73 at a part 72*c* on its root side so that the signal terminal parts 71*b* and 72*b* are separated from each other by a distance $Lx_{11}$. The signal terminal part 71*b* includes a step-like part 71*d* having a step-like shape in a position close to the root-side part 71*c*. The signal terminal part 72*b* includes an arcuate part 72*d* having an arcuate shape in a position close to the root-side part 72*c*.

The signal terminal part 72*b* gains length by including the arcuate part 72*d* so that a transmission line length $L_1$ along the signal contact member 71 between the end $P_1$ of the signal contact part 71*a* and the end $P_4$ of the signal terminal part 71*b* is equal to a transmission line length $L_2$ along the signal contact member 72 between the end $Q_1$ of the signal contact part 72*a* and the end $Q_4$ of the signal terminal part 72*b*.

The part of the signal terminal part 71*b* from $P_4$ to position $P_3$ in the step-like part 71*d* and the part of the signal terminal part 72*b* from $Q_4$ to position $Q_3$ in the arcuate part 72*d* oppose and extend parallel to each other. That is, the part of the signal terminal part 71*b* from its end to a position as close to the signal contact part 71*a* as possible and the part of the signal terminal part 72*b* from its end to a position as close to the signal contact part 72*a* as possible oppose and extend parallel to each other.

Referring to FIG. 5, each ground contact member 80 includes a plate-like base part 81, ground contact parts 82 and 83 extending in a fork-like shape in the $Z_1$ direction from the base part 81 on its $Z_1$ side, and ground terminal parts 84 and 85 extending in the $Y_2$ and $Y_1$ directions, respectively, from the base part 81 on its $Z_2$ side.

The signal contact pairs 70 and the ground contact members 80 are disposed alternately along the X-axis in the order of, for instance, a first ground contact member 80-1, a first signal contact pair 70-1, a second ground contact member 80-2, a second signal contact pair 70-2, . . . as shown in FIG. 6.

Referring to FIGS. 3 and 6, the signal terminal parts 71*b* and 72*b* of each signal contact pair 70 extend in the $Y_2$ direction along the bottom face 56 of the housing 51. The ground terminal parts 84 and 85 of each ground contact member 80 extend in the $Y_2$ and $Y_1$ directions, respectively, along the bottom face 56 of the housing 51. Referring to FIGS. 2 and 3, the end portions of the signal terminal parts 71*b* and 72*b* and the end portions of the ground terminal parts 84 project in the $Y_2$ direction from the lengthwise face 52 of the housing 51, and are disposed at the same pitch $p_1$. The end portions of the ground terminal parts 85 project in the $Y_1$ direction from the lengthwise face 53 of the housing 51, and are disposed at the same pitch $p_2$. The pitch $p_2$ is thrice the pitch $p_1$.

Referring to FIG. 6, the first signal contact pair 70-1 is sandwiched to be shielded between the first ground contact member 80-1 on the $X_1$ side and the second ground contact member 80-2 on the $X_2$ side. The same configuration applies to the second signal contact pair 70-2. The signal contact members 71 and 72 have their respective plate-like base parts 71*a*1 and 72*a*1 opposing the plate-like base parts 81 of the ground contact members 80.

Figure 7:
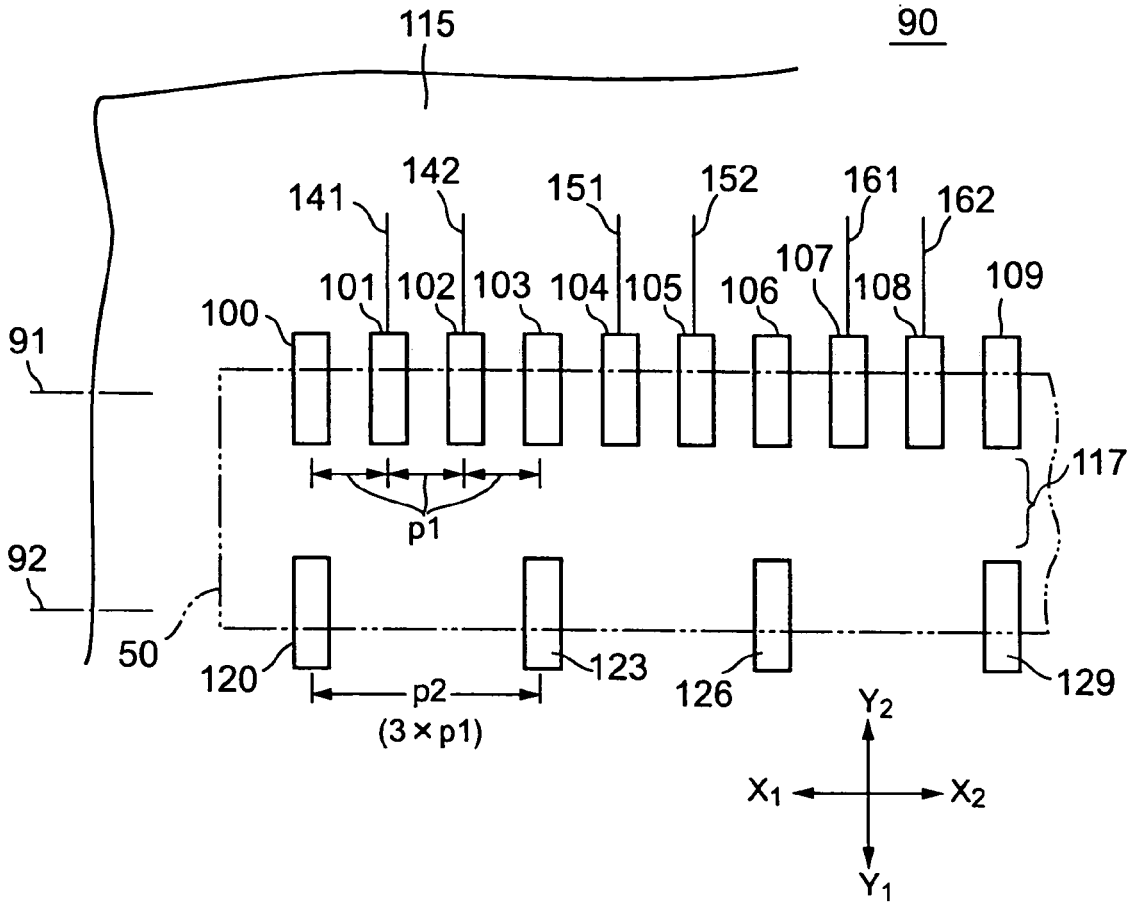
FIG. 7 is an enlarged view of part of the printed circuit board on which part the jack connector is mounted according to the first embodiment of the present invention.

FIG. 7 is a diagram showing the pattern of part of a printed circuit board 90 on which part the differential transmission jack connector 50 is mounted. In a first line 91, a ground pad 100, a first signal pad 101, a second signal pad 102, a ground pad 103, a first signal pad 104, a second signal pad 105, a ground pad 106, a first signal pad 107, a second signal pad 108, a ground pad 109, are arranged at the same pitch $p_1$. In a second line 92, ground pads 120, 123, 126, 129, . . . are arranged at the same pitch $p_2$. These pads are formed in accordance with the disposition of the signal terminal parts 71*b* and 72*b* and the ground terminal parts 84 and 85 of the jack connector 50.

Signal wiring patterns 141, 142, 151, 152, 161, and 162 are extended from the signal pad 101, 102, 104, 105, 107, and 108, respectively. The first signal pads 101, 104, and 107 are disposed next to the second signal pads 102, 105, and 108, respectively, in the same first line 91. Accordingly, the signal wiring patterns 141, 142, 151, 152, 161, and 162 are formed using a wide area 115 on the $Y_2$ side of the first line 91. There is no need to use a narrow belt-like part 117 between the first and second lines 91 and 92 for providing signal wiring patterns. The signal wiring patterns 141 and 142 extend parallel to each other so as to couple "+" and "−" signals. The signal wiring patterns 151 and 152 extend parallel to each other so as to couple "+" and "−" signals. The signal wiring patterns 161 and 162 extend parallel to each other so as to couple "+" and "−" signals. Since the wide area 115 on the $Y_2$ side of the first line 91 is used, it is easy to form the signal wiring patterns 141, 142, 151, 152, 161, and 162.

Referring to FIGS. 3 and 7, the differential transmission jack connector 50 has its ground terminal part 84-1, signal terminal parts 72-1*b* and 71-1*b*, ground terminal part 84-2, etc., on the $Y_2$ side soldered to the corresponding pads 100, 101, 102, 103, etc., and has its ground terminal parts 85-1, 85-2, etc. on the $Y_1$ side soldered to the corresponding pads 120, 123, etc., so as to be mounted in an upright position (in the X-Y plane) on the printed circuit board 90 as indicated by a double-dot chain line in FIG. 7.

Each ground contact member 80 has its ground terminal part 84 extending in the $Y_2$ direction and ground terminal part 85 extending in the $Y_1$ direction soldered to, for instance, the ground pads 100 and 120, respectively. If the ground contact member 80 does not have the ground terminal part 85, a portion of the plate-like base part 81 remote from the ground terminal part 84, which portion is indicated by circle A in FIG. 5, may be prevented from functioning sufficiently as ground so as to be prone to pick up noise. According to this embodiment, however, the ground terminal parts 84 and 85 extend in the $Y_2$ and $Y_1$ directions, respectively, so that the plate-like base part 81 functions as ground, thus achieving an improvement with respect to noise.

Figure 8:
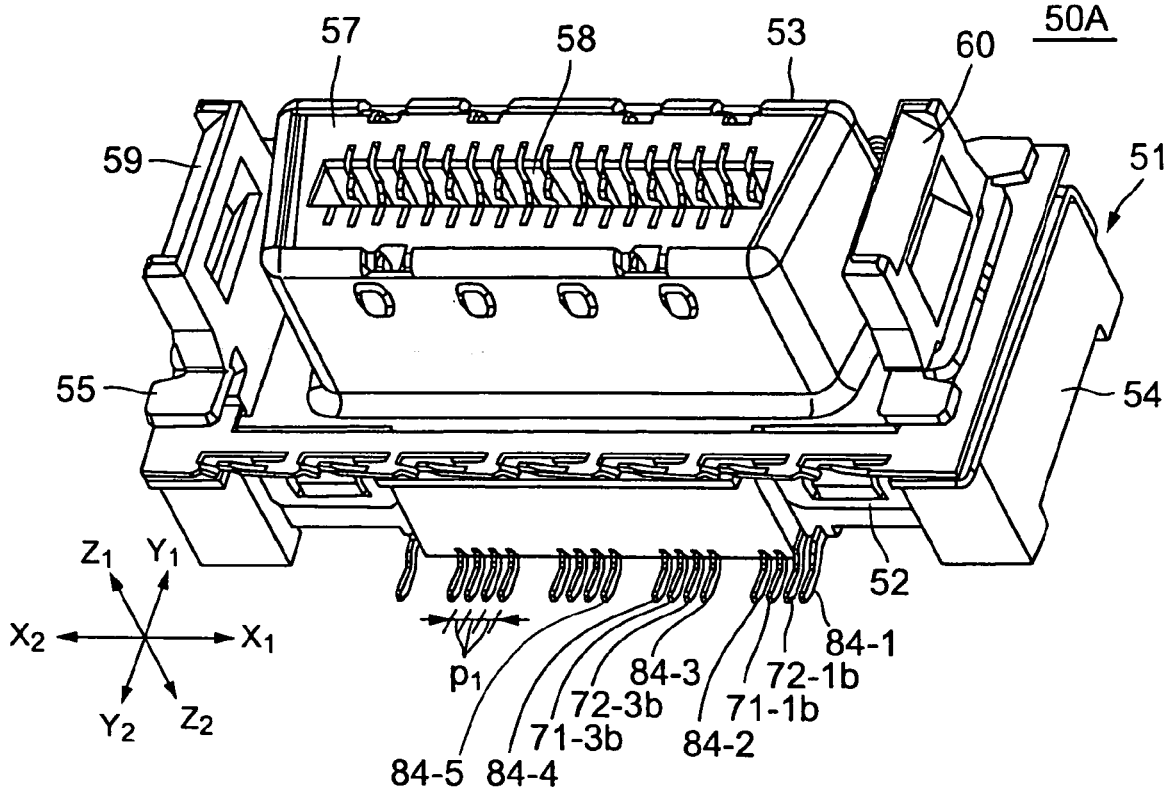
FIG. 8 is a perspective view of a differential transmission jack connector according to a second embodiment of the present invention.
Figure 9:
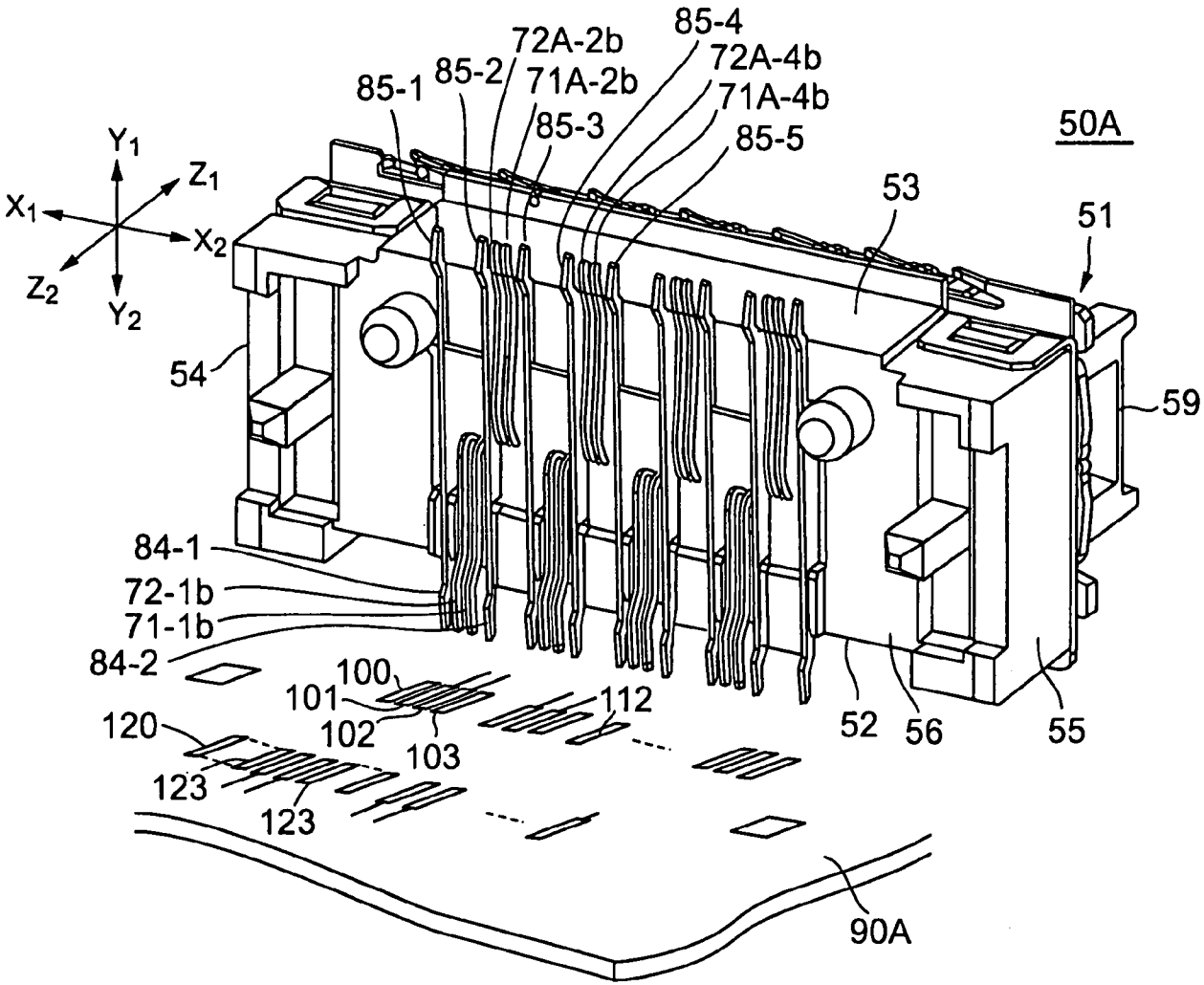
FIG. 9 is a diagram showing the jack connector and a printed circuit board, the jack connector being viewed from its bottom side, according to the second embodiment of the present invention.
Figure 10:
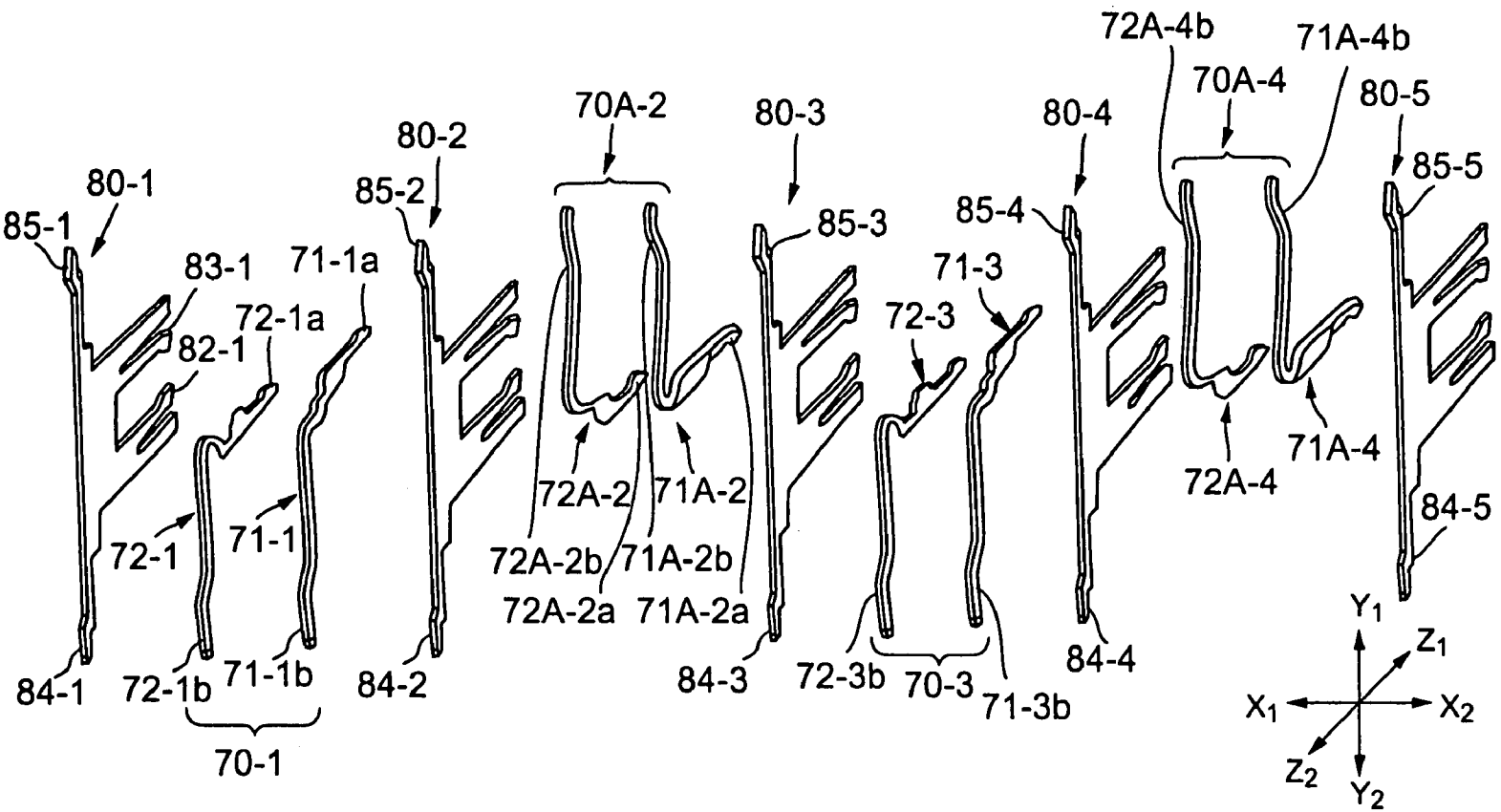
FIG. 10 is a diagram showing an arrangement of the signal contact pairs and the ground contact members in the jack connector according to the second embodiment of the present invention.

FIGS. 8 and 9 are diagrams showing a straight-type differential transmission jack connector 50A according to a second embodiment of the present invention. FIG. 9 shows the jack connector 50A rotated 180° about its axis extending along the Y-axis from the position shown in FIG. 8. In the second embodiment, the same elements as those of the first embodiment are referred to by the same numerals, and a description thereof is omitted. In a housing 51A of the jack connector 50A, the first ground contact member 80-1, the first signal contact pair 70-1, the second ground contact member 80-2, a second signal contact pair 70A-2, a third ground contact member 80-3, a third signal contact pair 70-3, a fourth ground contact member 80-4, a fourth signal contact pair 70A-4, and a fifth ground contact member 80-5 are arranged along the X-axis as shown in FIG. 10. The signal terminal parts 71*b* and 72*b* of the signal contact pairs 70 extend alternately in different directions. That is, signal terminal parts 71-1*b* and 72-1*b* of the first signal contact pair 70-1 extend in the $Y_2$ direction, signal terminal parts 71A-2*b* and 72A-2*b* of the second signal contact pair 70A-2 extend in the $Y_1$ direction, signal terminal parts 71-3*b* and 72-3*b* of the third signal contact pair 70-3 extend in the $Y_2$ direction, and signal terminal parts 71A-4*b* and 72A-4*b* of the fourth signal contact pair 70A-4 extend in the $Y_1$ direction.

The first signal contact pair 70-1 is sandwiched to be shielded between the first ground contact member 80-1 on the $X_1$ side and the second ground contact member 80-2 on the $X_2$ side. The second signal contact pair 70A-2 is sandwiched to be shielded between the second ground contact member 80-2 on the $X_1$ side and the third ground contact member 80-3 on the $X_2$ side. The third signal contact pair 70-3 is sandwiched to be shielded between the third ground contact member 80-3 on the $X_1$ side and the fourth ground contact member 80-4 on the $X_2$ side. The fourth signal contact pair 70A-4 is sandwiched to be shielded between the fourth ground contact member 80-4 on the $X_1$ side and the fifth ground contact member 80-5 on the $X_2$ side.

Figure 11:
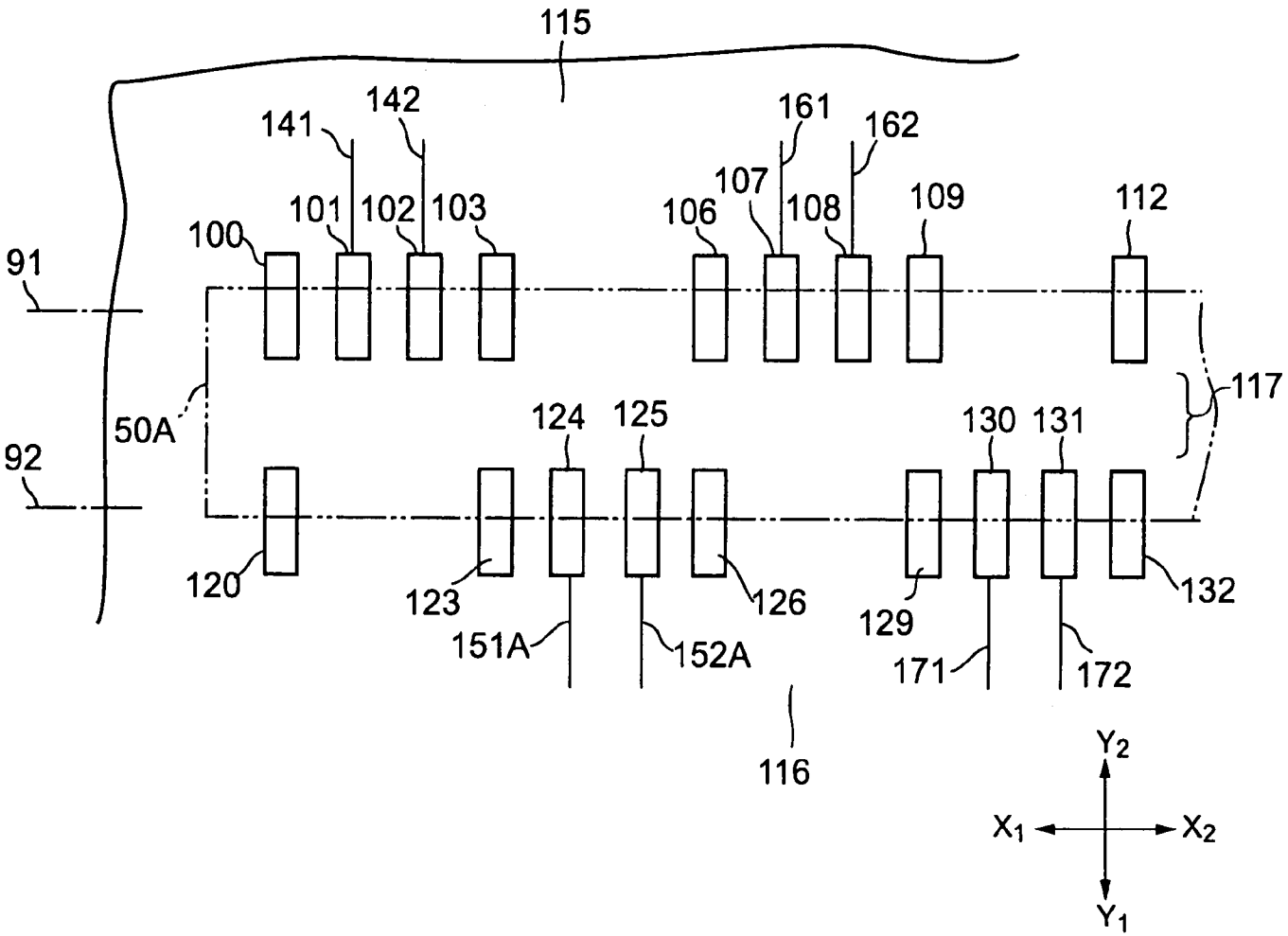
FIG. 11 is an enlarged view of part of the printed circuit board on which part the jack connector is mounted according to the second embodiment of the present invention.

FIG. 11 is a diagram showing the pattern of part of a printed circuit board 90A on which part the differential transmission jack connector 50A is mounted. In the first line 91, the ground pad 100, the first signal pad 101, the second signal pad 102, the ground pad 103, the ground pad 106, the first signal pad 107, the second signal pad 108, the ground pad 109, a ground pad 112, . . . are arranged. The ground pads 103 and 106 are spaced at an interval accommodating two pads (or the ground pads 103 and 106 are arranged at the pitch p2 of FIG. 7). The ground pads 109 and 112 are also spaced at the same interval. In the second line 92, the ground pad 120, the ground pad 123, a first signal pad 124, a second signal pad 125, the ground pad 126, the ground pad 129, a first signal pad 130, a second signal pad 131, a ground pad 132, . . . are arranged. The ground pads 120 and 123 are spaced at the interval accommodating two pads. The ground pads 126 and 129 are also spaced at the same interval. These pads are formed in accordance with the arrangement of the signal terminal parts 71*b* and 72*b* and the ground terminal parts 84 and 85 of the jack connector 50A.

The signal wiring patterns 141 and 142 extend in parallel in the $Y_2$ direction from the first and second signal pads 101 and 102, respectively. Signal wiring patterns 151A and 152A extend in parallel in the $Y_1$ direction from the first and second signal pads 124 and 125, respectively. The signal wiring patterns 161 and 162 extend in parallel in the $Y_2$ direction from the first and second signal pads 107 and 108, respectively. Signal wiring patterns 171 and 172 extend in parallel in the $Y_1$ direction from the first and second signal pads 130 and 131, respectively. The signal wiring patterns 141, 142, 161, and 162 are formed using the wide area 115. The signal wiring patterns 151A, 152A, 171, and 172 are formed using a wide area 116 on the $Y_1$ side of the second line 92. Since the dispersed wide areas 115 and 116 are used, it is easy to form the signal wiring patterns 141, 142, 151A, 152A, 161, 162, 171, and 172.

Referring to FIGS. 9 through 11, the differential transmission jack connector 50A has its ground terminal part 84-1, the signal terminal parts 72-1*b* and 71-1*b*, the ground terminal parts 84-2 and 84-3, the signal terminal parts 72-3*b* and 71-3*b*, the ground terminal parts 84-4 and 84-5, etc., on the $Y_2$ side soldered to the corresponding pads 100 through 103, 106 through 109, 112, etc., and has its ground terminal parts 85-1 and 85-2, the signal terminal parts 72A-2*b* and 71A-2*b*, the ground terminal parts 85-3 and 85-4, the signal terminal parts 72A-4*b* and 71A-4*b*, the ground terminal part 85-5, etc. on the $Y_1$ side soldered to the corresponding pads 120, 123 through 126, 129 through 132, etc., so as to be mounted in an upright position on the printed circuit board 90A as indicated by a double-dot chain line in FIG. 11.

The present invention is not limited to the specifically disclosed embodiments, and variations and modifications may be made without departing from the scope of the present invention.

The present application is based on Japanese priority patent application No. 2003-148693, filed on May 27, 2003, the entire contents of which are hereby incorporated by reference.

What is claimed is:

1. A connector for differential transmission, comprising:

a housing made of an insulating material, the housing including a connector connection opening on a first face thereof;

a plurality of signal contact pairs each including first and second signal contact members, the signal contact members each including a signal terminal part; and a plurality of ground contact members each including a first ground terminal part and a second ground terminal part extending in opposite directions, respectively, wherein the signal contact pairs and the ground contact members are disposed alternately in the housing so that the signal terminal parts of the first and second signal contact members of the signal contact pairs and the first and second ground terminal parts of the ground contact members are provided on a second face of the housing, the second face opposing the first face thereof, so as to have an arrangement of the signal terminal parts of the first and second signal contact members of the signal contact pairs and the first ground terminal parts of the ground contact members in a first line and an arrangement of only the second ground terminal parts of the ground contact members in a second line; and the signal terminal parts of the first and second signal contact members extend in a same direction in each signal contact pair.

2. The connector as claimed in claim 1, wherein the signal terminal part of the first signal contact member and the signal terminal part of the second signal contact member of each signal contact pair include respective bent portions so as to be equal in length.

3. The connector as claimed in claim 1, wherein the ground terminal parts of each ground contact member are two in number and extend in opposite directions.

4. The connector as claimed in claim 1, wherein the signal terminal parts of the first and second signal contact members of the signal contact pairs extend in the same direction.

5. A connector for differential transmission, comprising:

a housing made of an insulating material, the housing including a connector connection opening on a first face thereof;

a plurality of signal contact pairs each including first and second signal contact members, the signal contact members each including a signal terminal part; and a plurality of ground contact members each including a plurality of ground terminal parts, wherein: the signal contact pairs and the ground contact members are disposed alternately in the housing so that the signal terminal parts of the first and second signal contact members of the signal contact pairs and the ground terminal parts of the ground contact members are provided on a second face of the housing, the second face opposing the first face thereof; and the signal terminal parts of the first and second signal contact members extend in a first direction in first signal contact pairs, and the signal terminal parts of the first and second signal contact members extend in a second direction opposite to the first direction in second signal contact pairs, the first and second signal contact pairs being arranged in a first line and a second line, respectively, in a staggering manner, wherein only one of the first and second signal contact pairs is provided between each adjacent ground contact member.

6. The connector as claimed in claim 5, wherein the signal terminal part of the first signal contact member and the signal terminal part of the second signal contact member of each signal contact pair include respective bent portions so as to be equal in length.

7. The connector as claimed in claim 5, wherein the ground terminal parts of each ground contact member are two in number and extend in the first and second opposite directions.

8. The connector as claimed in claim 5, wherein the first and second ones of the signal contact pairs are adjacent to one of the ground contact members.

9. The connectors as claimed in claim 5, wherein the signal terminal parts of the first of the signal contact pairs projected from a first lengthwise side of the housing and the signal terminal parts of the second of the signal contact pairs project from a second lengthwise side of the housing, the second lengthwise side being opposite the first lengthwise side.

10. A connector, comprising:

a housing including a connector connection opening on a first face thereof;

a plurality of signal contact pairs, each signal contact pair including first and second signal contact members, and each signal contact member including a signal terminal part; and a plurality of ground contact members, each ground contact member including a first ground terminal part and a second ground terminal part extending in opposite directions, respectively, wherein the signal contact pairs and the ground contact members are disposed alternately in the housing so that the signal terminal parts and the first and second ground terminal parts are provided on a second face of the housing, the second face opposing the first face thereof, so that the signal terminal parts of the first and second signal contact members and the first ground terminal parts are arranged in a first line and the second ground terminal parts are arranged in a second line, and the signal terminal parts extend in a same direction.

* * * * *